US007037146B2

(12) United States Patent
Nakamura

(10) Patent No.: US 7,037,146 B2
(45) Date of Patent: May 2, 2006

(54) CIRCUIT BOARD CONNECTOR

(75) Inventor: Keiichi Nakamura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/153,154

(22) Filed: Jun. 15, 2005

(65) Prior Publication Data

US 2005/0277312 A1 Dec. 15, 2005

(30) Foreign Application Priority Data

Jun. 15, 2004 (JP) ..... 2004-176571

(51) Int. Cl.
*H01R 13/42* (2006.01)

(52) U.S. Cl. ..... 439/751; 439/82

(58) Field of Classification Search ..... 439/751, 439/82, 78, 572
See application file for complete search history.

(56) References Cited

U.S. PATENT DOCUMENTS 5,094,634 A * 3/1992 Dixon et al. ..... 439/751
5,453,016 A 9/1995 Clark et al.
5,504,989 A 4/1996 Clark et al.
5,702,257 A * 12/1997 Millhimes ..... 439/79
5,940,967 A * 8/1999 Wuyts et al. ..... 29/845
6,095,826 A * 8/2000 Potters ..... 439/79
6,866,523 B1 * 3/2005 Yamashita ..... 439/79
2003/0049972 A1 * 3/2003 Aoki ..... 439/751

* cited by examiner

*Primary Examiner*—Chandrika Prasad
*Assistant Examiner*—Vladimir Imas
(74) *Attorney, Agent, or Firm*—Gerald E. Hespos; Anthony J. Hespos

(57) ABSTRACT

Inserting holes (25) are formed in a row in a base wall (21) of a housing (20) and receive press-fit terminals (10). Each inserting hole (25) has a relatively wide through hole section (26) for permitting the passage of a resilient bulge (12) of the press-fit terminal (10) and a narrower press-in hole section (28) for receiving a press-in portion (13) of the press-fit terminal (10). The width direction of the through hole section (26) is normal to an arranging direction of the terminals (10) and the width direction of the press-in hole section (28) is parallel with the arranging direction of the terminals (10). The resilient bulge (12) of the press-fit terminal (10) is inserted through the through hole section (26) and then the press-fit terminal (10) is turned by 90° about its longitudinal axis. Thereafter, the press-in portion (13) is pressed into the press-in hole (28).

12 Claims, 11 Drawing Sheets

CIRCUIT BOARD CONNECTOR

BACKGROUND OF THE INVENTION

1. Field of the Invention

The invention relates to a circuit board connector with press-fit terminals.

2. Description of the Related Art

U.S. Pat. No. 5,453,016, U.S. Pat. No. 5,504,989 and FIG. 11 herein relate to a circuit board connector. With reference to FIG. 11, the circuit board connector includes a housing 1 and a receptacle 2 is formed in an upper surface of the housing 1 for receiving a mating connector. The receptacle has a bottom wall 2A and press-fit terminals 3 penetrate the bottom wall 2A. Each press-fit terminal 3 has a resilient bulge 4, a stopper 5 above the resilient bulge 4 and a press-in portion 6 above the stopper 5. Upper ends of the press-fit terminals 3 project into the receptacle 2, and the resilient bulges 4 project down from the bottom wall 2A for insertion into through holes of a printed circuit board for connection.

The press-fit terminals 3 are inserted through press-in holes 7 in the bottom wall 2A from below until the stoppers 5 contact the edges of the press-in holes 7. However, the forces for locking the press-fit terminals 3 decrease in response to downward forces on the press-fit terminals 3, for example, upon fitting the mating connector into the receptacle 2.

The press-fit terminals 3 may be inserted from above to increase the locking forces in the downward direction. However, the press-in portions 6 are pressed into the press-in holes 7 after the resilient bulges 4 pass through the press-in holes 7. Thus, the press-fit portions 6 must be wider than the resilient bulges 4, thereby increasing the width of the press-fit terminals 3. This has been a problem if there are narrow intervals between the terminals 3.

The invention was developed in view of the above problem and an object thereof is to enable the terminal arrangement at narrower intervals while ensuring sufficient retaining forces.

SUMMARY OF THE INVENTION

The invention relates to a circuit board connector. The connector has a housing with a connecting part for receiving a mating connector. The connector also has a plurality of press-fit terminals. A resilient bulge is formed at the leading end of each press-fit terminal and a press-in portion is provided behind the resilient bulge. The press-fit terminals are arranged side-by-side and penetrate a back wall of the connecting part. Thus, rear ends of the press-fit terminals project into the connecting part and the resilient bulges project towards a side opposite from the connecting part. The resilient bulges can be inserted into corresponding connection holes of a circuit board for connection.

The back wall of the housing has a plurality of insertion portions for the respective press-fit terminals. Each insertion portion has a narrow press-in hole for receiving the corresponding press-in portion and a wide through hole for receiving the corresponding resilient bulge. The width direction of the press-in hole preferably is aligned with an arranging direction of the press-fit terminals and the through hole crosses the press-in hole at right angles.

The resilient bulge and the press-in portion of each press-fit terminal may bulge out in the same plane. Thus, the rotational posture of the press-fit terminal is turned 90° after the resilient bulge passes through the through hole. The press-in portion then can be pressed into the press-in hole.

The resilient bulge and the press-in portion of each press-fit terminal may cross each other at right angles. Thus, the resilient bulge is inserted first through the through hole and then the press-in portion is pressed into the press-in portion while the press-fit terminal is kept in a specified rotational posture.

The press-fit terminals are inserted from the side of the connecting part of the housing. Pushing forces act on the press-fit terminals in an inserting direction as the mating connector is fit into the connecting part and considerable locking forces are created. The press-fit terminals are prevented from escaping when the mating connector is fit, thereby improving connection reliability between the press-fit terminals and terminals of the mating connector.

The resilient bulge and the press-in portion are inserted respectively into the through hole and the press-in hole. Thus, the press-in portions can be narrower than the resilient bulges even though the resilient bulge and the press-in portion are inserted successively in this order. Further, the width direction of the press-in holes is aligned with the arranging direction of the press-fit terminals so that the intervals of the press-in holes can be narrowed. Accordingly, the press-fit terminals can be arranged side by side at narrower intervals.

DETAILED DESCRIPTION OF THE PREFERRED EMBODIMENTS

Figure 1:
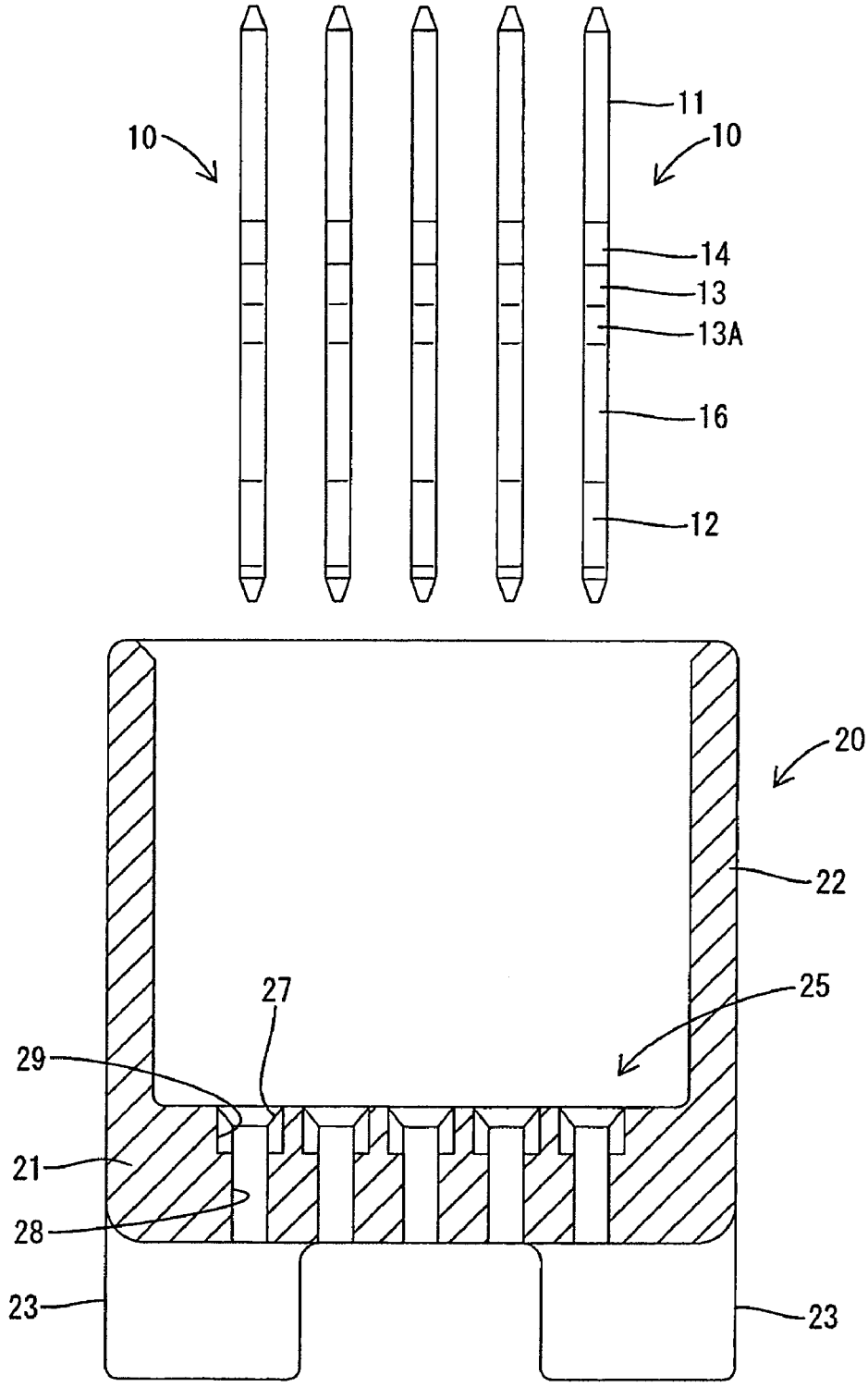
FIG. 1 is a section viewed from front showing a state where press-fit terminals according to one embodiment of the present invention.
Figure 2:
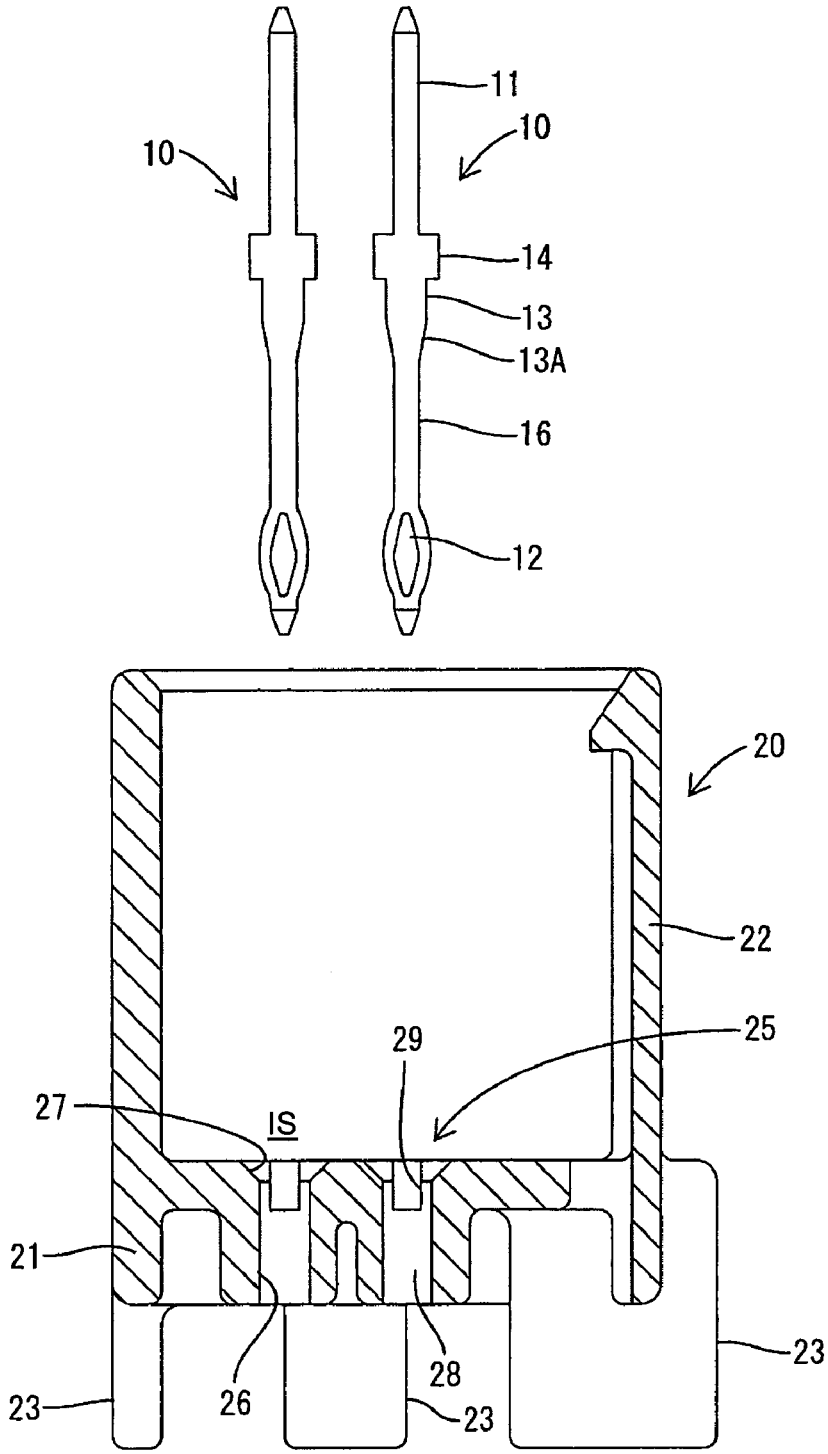
FIG. 2 is a section viewed sideways.

A circuit board connector according to the invention is illustrated in FIGS. 1 to 10. The circuit board connector has ten press-fit terminals 10 pressed into a housing 20, as shown in FIGS. 1 and 2, and is mounted on a circuit board 30.

Figure 5A:
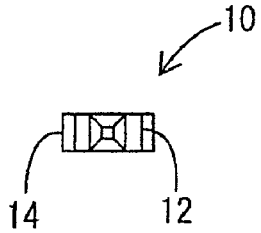
FIGS. 5(A), 5(B) and 5(C) are a bottom view, a front view and a side view of the press-fit terminal.
Figure 5B:
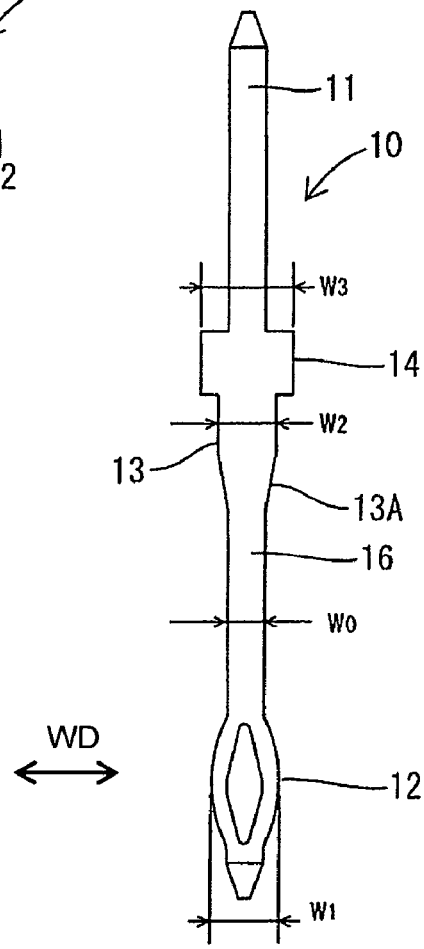
Figure 5C:
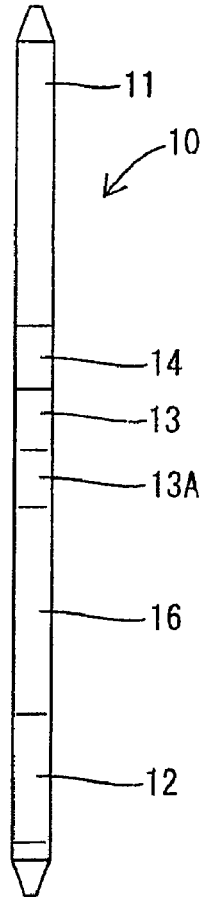
Figure 9:
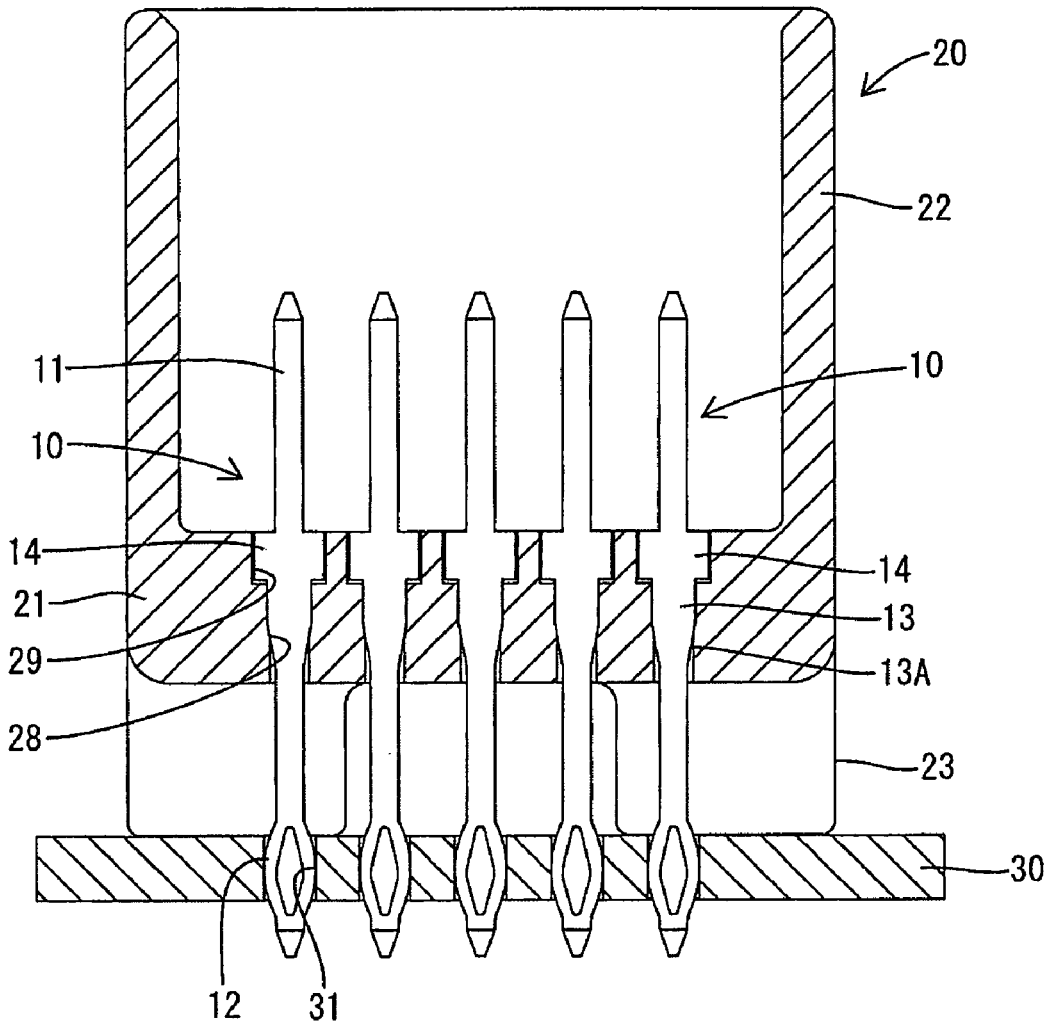
FIG. 9 is a section viewed from front showing a state where the press-fit terminals are mounted.

Each press-fit terminal 10 is formed into the shape shown in FIGS. 5(A) to 5(C) by press-working a metal plate having good electrical conductivity. The press-fit terminal 10 is a long narrow rectangular bar with a terminal connecting portion 11 at one end. The leading end of the terminal connecting portion 11 is tapered for guiding the press-fit terminal 10 into connection with a mating terminal. A resilient bulge 12 is formed at the opposite end of the press-fit terminal 10 and is configured for connection with the circuit board 30. The resilient bulge 12 bulges out in opposite widthwise directions and has a hollow middle. Thus, the resilient bulge 12 can be widened and narrowed resiliently along the width direction WD. More specifically, the resilient bulge 12 narrows for insertion into a through hole 31 of the circuit board 30. However, the resilient bulge 12 then exerts a resilient restoring force against a contact formed on the inner circumferential surface of the through hole 31, as shown in FIG. 9.

A press-in portion 13 bulges out in opposite width directions at a longitudinal middle of the press-fit terminal 10. The press-in portion 13 has a width w2 that is less than maximal width w1 of the resilient bulge 12. Slanted left and right edges 13A cause the bottom of the press-in portion 13 to narrow gradually towards the bottom.

A stopper 14 is formed continuously with and above the press-in portion 13 and between the press-fit portion 13 and the terminal connecting portion 11. The stopper 14 bulges out from the press-in portion 13 to form steps, and has a width w3 slightly larger than the maximal width w1 of the resilient bulge 12.

The housing 20 is made of a synthetic resin and has a base wall 21. A rectangular tubular receptacle 22 extends up from the base wall 22 and has an open end. An unillustrated mating connector is fittable into the receptacle 22 from above. Legs 23 project down from the base wall 21 for contacting the outer surface of the circuit board 30.

Figure 3:
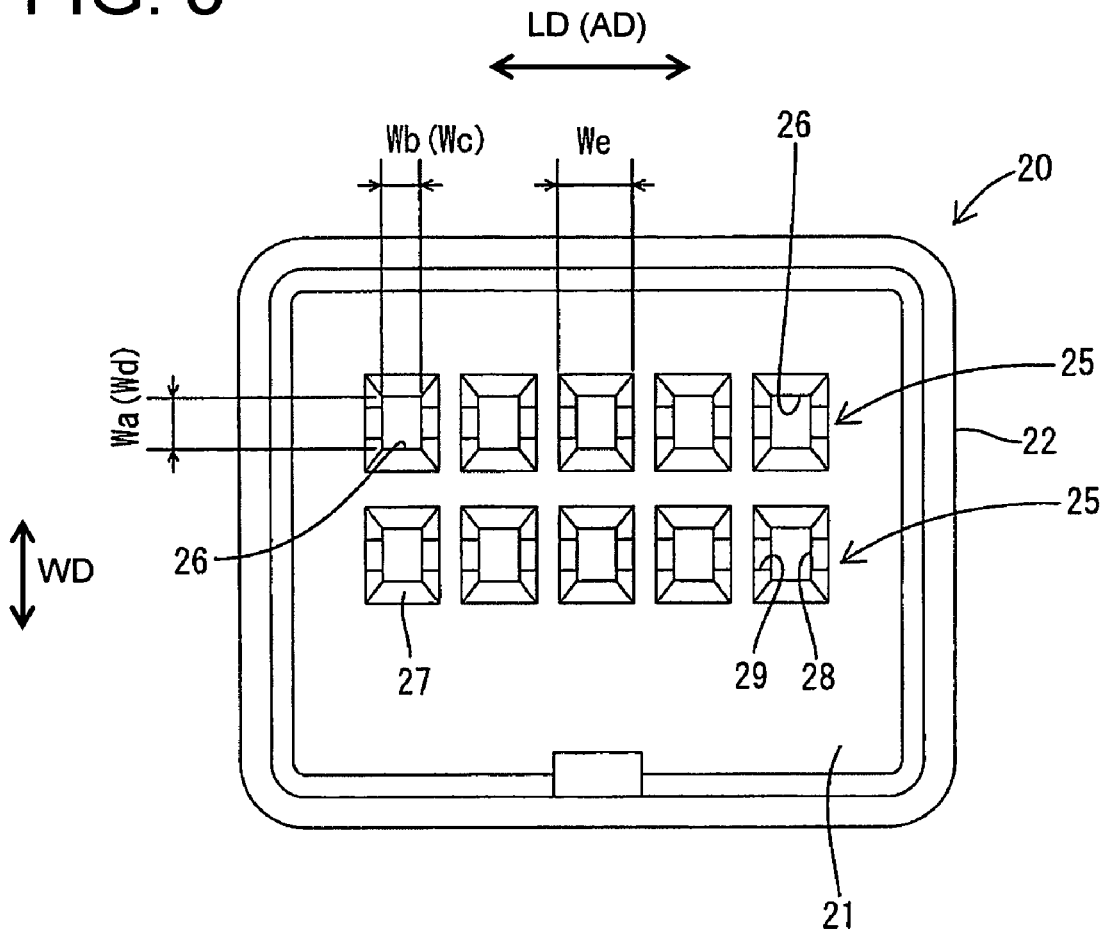
FIG. 3 is a plan view of a housing.

The base wall 21 of the housing 20 has inserting portions 25 at five positions in each of front and rear rows, as shown in FIG. 3. The inserting portions 25 in each row are arranged at even intervals, and the inserting portions 25 in the front row align with those in the rear row. The press-fit terminals 10 can be inserted through the press-fit portions 25 from an inserting side IS.

As shown in FIG. 9, the base wall 21 has a thickness slightly larger than the length from the upper end of the stopper 14 of the press-fit terminal 10 to the bottom ends of the slanted edges 13A of the press-in portion 13. Each inserting portion 25 has a through hole 26 to permit passage of the resilient bulge 12 of the press-fit terminal 10 and a press-in hole 28 to receive the press-in portion 13. Both holes 26, 28 penetrate the base wall 21.

Figure 6A:
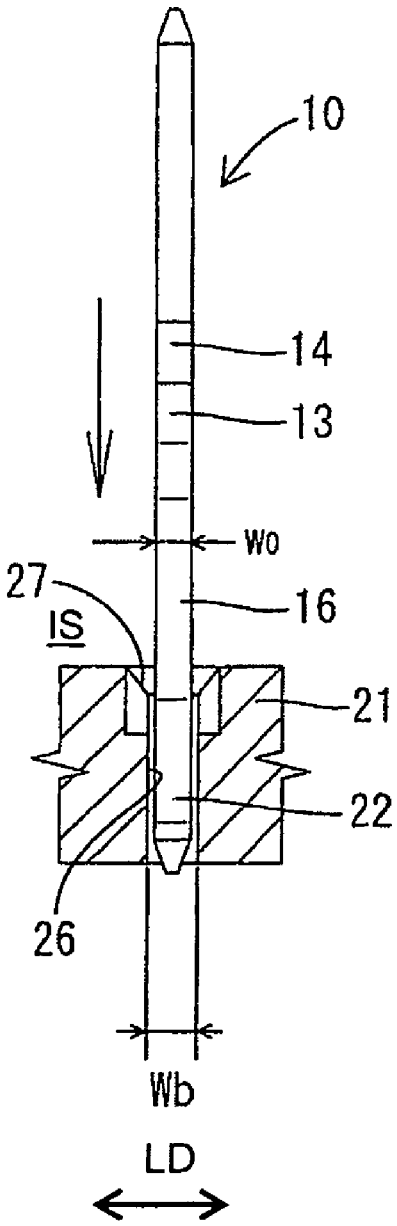
FIGS. 6(A) and 6(B) are partial sections showing a state where the press-fit terminal is being inserted, when viewed from front and sideways, respectively.
Figure 6B:
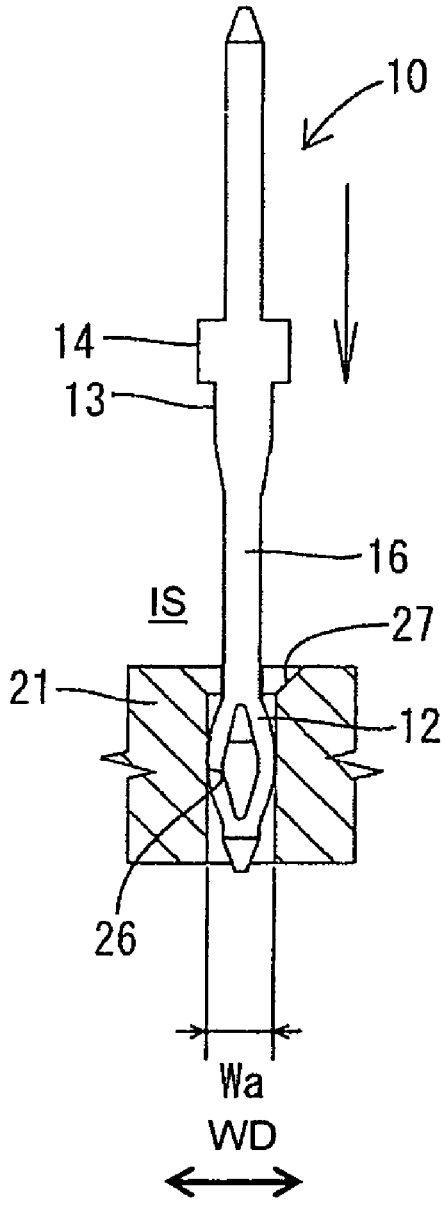

As shown in FIGS. 3 and 6B, the through hole 26 has a cross-sectional dimension Wa along the width direction WD to permit passage of the resilient bulge 12 with virtually no resilient compression. The through hole 26 also has a cross-sectional dimension Wb normal to the width direction WD slightly larger than the thickness w0 of the rectangular bar 16 of the press-fit terminal 10 (see FIG. 6A). The dimension Wb exceeds the thickness w0 to permit the rectangular bar 16 to rotate about its longitudinal axis in the through hole 26. The through holes 26 are formed so that the dimension Wa extends normal to an arranging direction of the press-fit terminals 10 in each of the front and rear rows, and hence along forward and backward directions. A guide 27 is formed at the entrance of each through hole 26 into the receptacle 22 and gradually widens towards the upper end in the receptacle 22.

Figure 4:
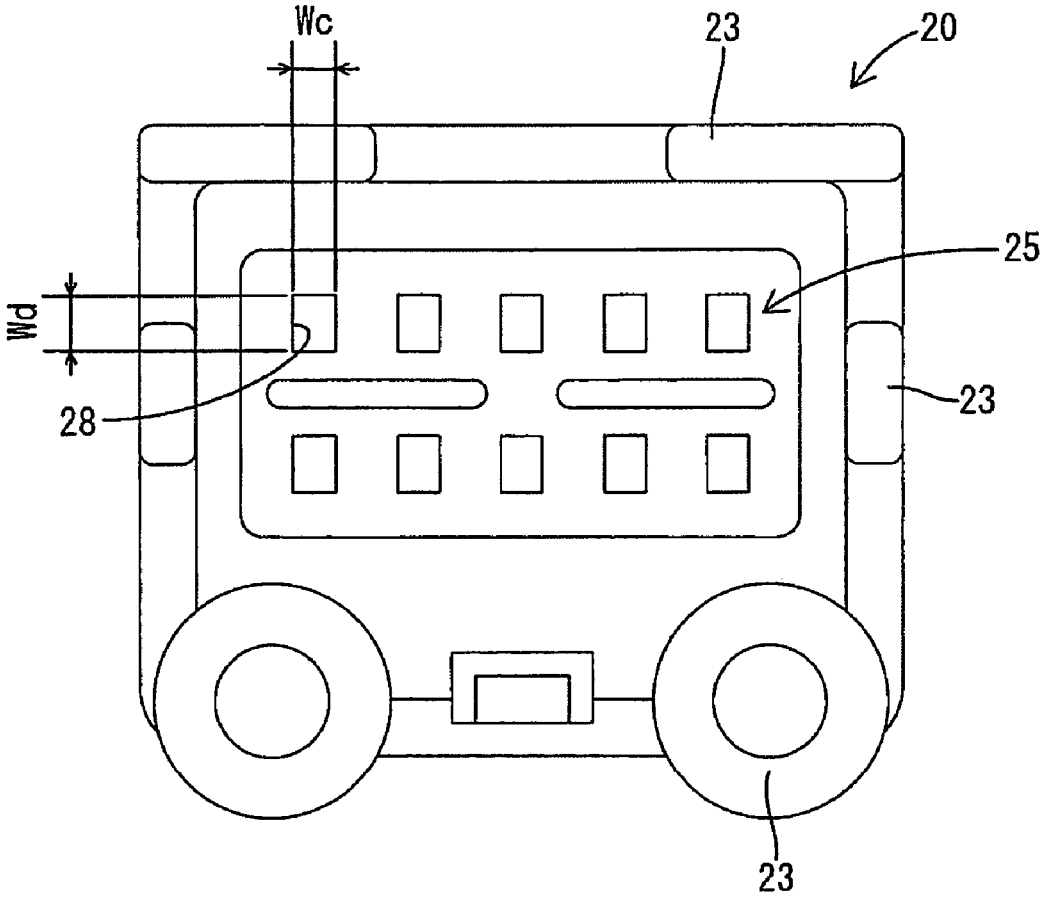
FIG. 4 is a bottom view of the housing.
Figure 8A:
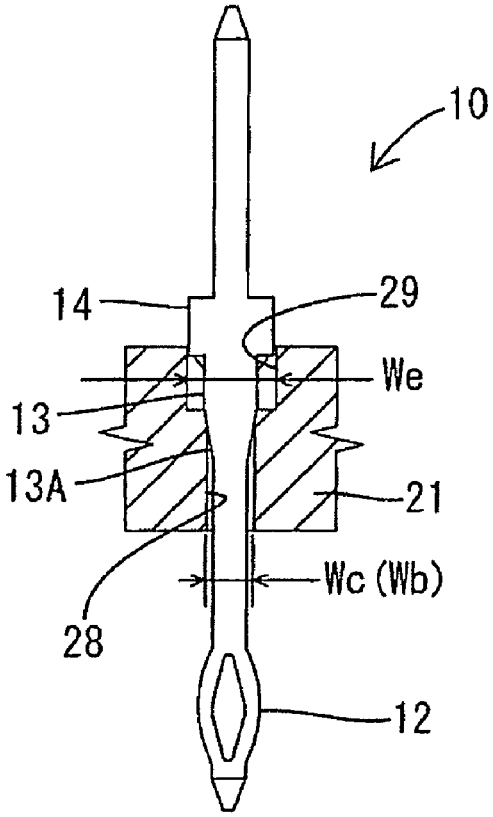
FIGS. 8(A) and 8(B) are partial sections when the pressing-in of the press-fit terminal is started, as viewed respectively from the front and side.
Figure 8B:
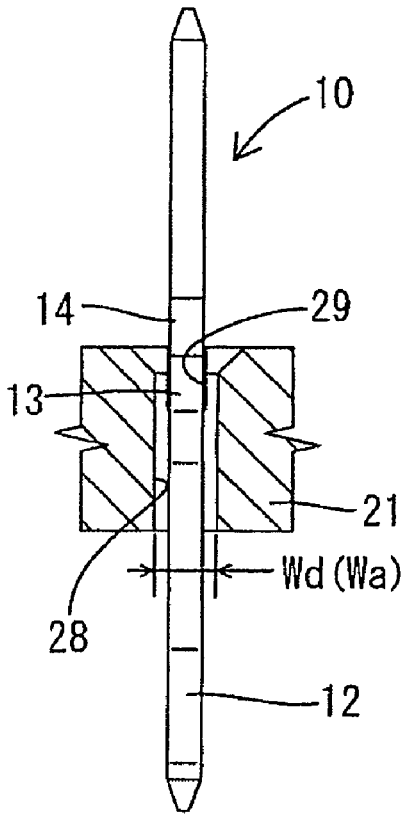

As shown in FIGS. 4 and 8, each press-in hole 28 has a cross-sectional dimension Wc between the width w0 of the rectangular bar 16 of the press-fit terminal 10 and the width w2 of the press-in portion 13 so that the press-in portion 13 can be pressed therein. The dimension Wc of the press-in hole 28 substantially equals the dimension Wb of the through hole 26, and hence is smaller than the dimension Wa of the through hole 26. It should be noted that the cross-sectional dimension Wd of the press-in hole 28 substantially equals the dimension Wa of the through hole 26.

The dimension Wc of the press-in hole 28 extends along the arranging direction AD of the press-fit terminals 10 in each of the front and rear rows. An accommodating hole 29 is formed at the entrance side of the press-in hole 28 for accommodating and contacting the stopper 14, as shown in FIG. 8(A). A lateral width We of the accommodating hole 29 lies within the lateral width of the guiding portion 27 as shown in FIG. 3, and the depth of the accommodating hole 29 is such that the upper end of the stopper 14 is flush with the upper surface of the base wall 21 when the stopper 14 is accommodated in the accommodating hole 29 as shown in FIG. 9.

Figure 7A:
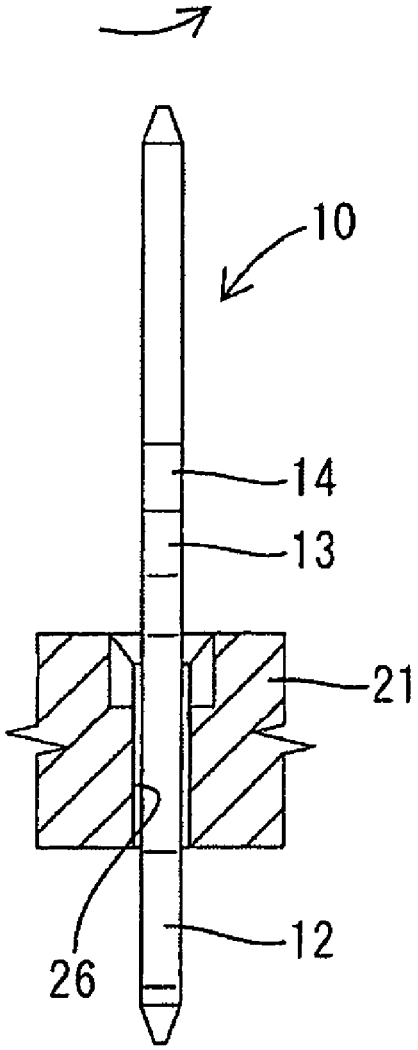
FIGS. 7(A) and 7(B) are partial sections showing a state where a resilient bulging portion of the press-fit terminal is located below the lower surface of a base wall, when viewed from front and sideways, respectively.
Figure 7B:
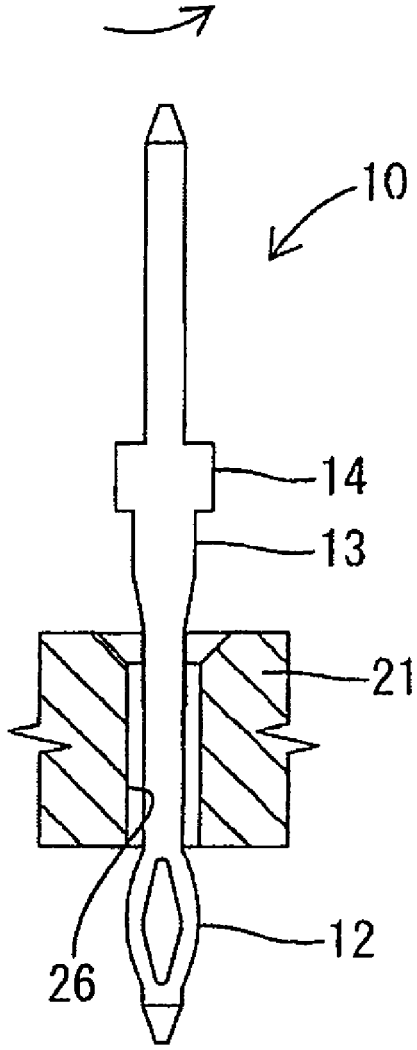

The press-fit terminal 10 can be inserted into the through hole 26 of the corresponding inserting portion 25 from the inserting side IS with the width direction WD of the press-fit terminal 10 aligned with forward and backward directions, as shown in FIG. 2. The resilient bulge 12 of the press-fit terminal 10 first passes through the through hole 26 with virtually no resilient compression, as shown in FIG. 6(B) while being centered by the guide 27. The press-fit terminal 10 is turned 90° about its longitudinal axis after the resilient bulge 12 comes down from the through hole 26, as shown in FIG. 7.

Figure 10:
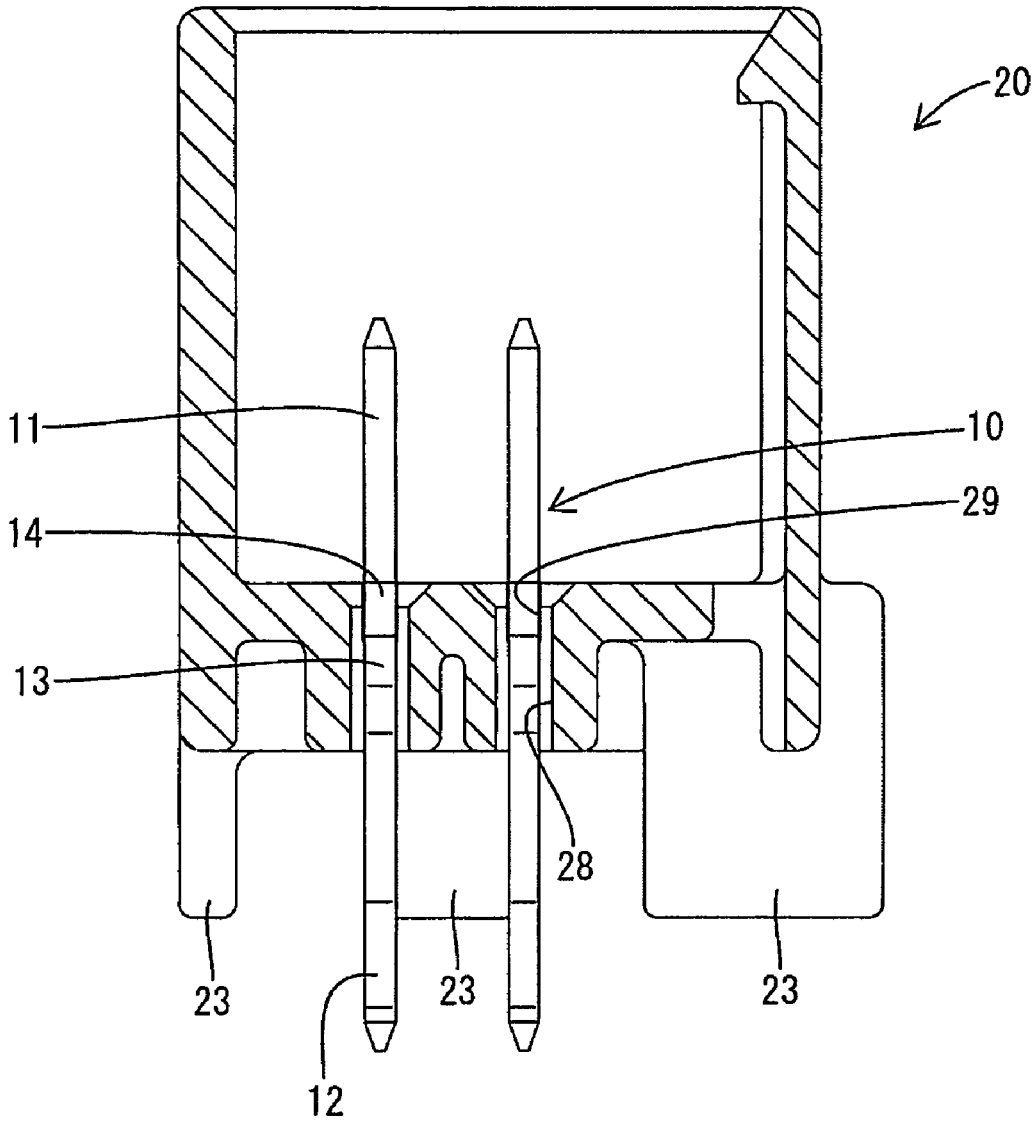
FIG. 10 is a section viewed sideways showing the state of FIG. 9.
Figure 11:
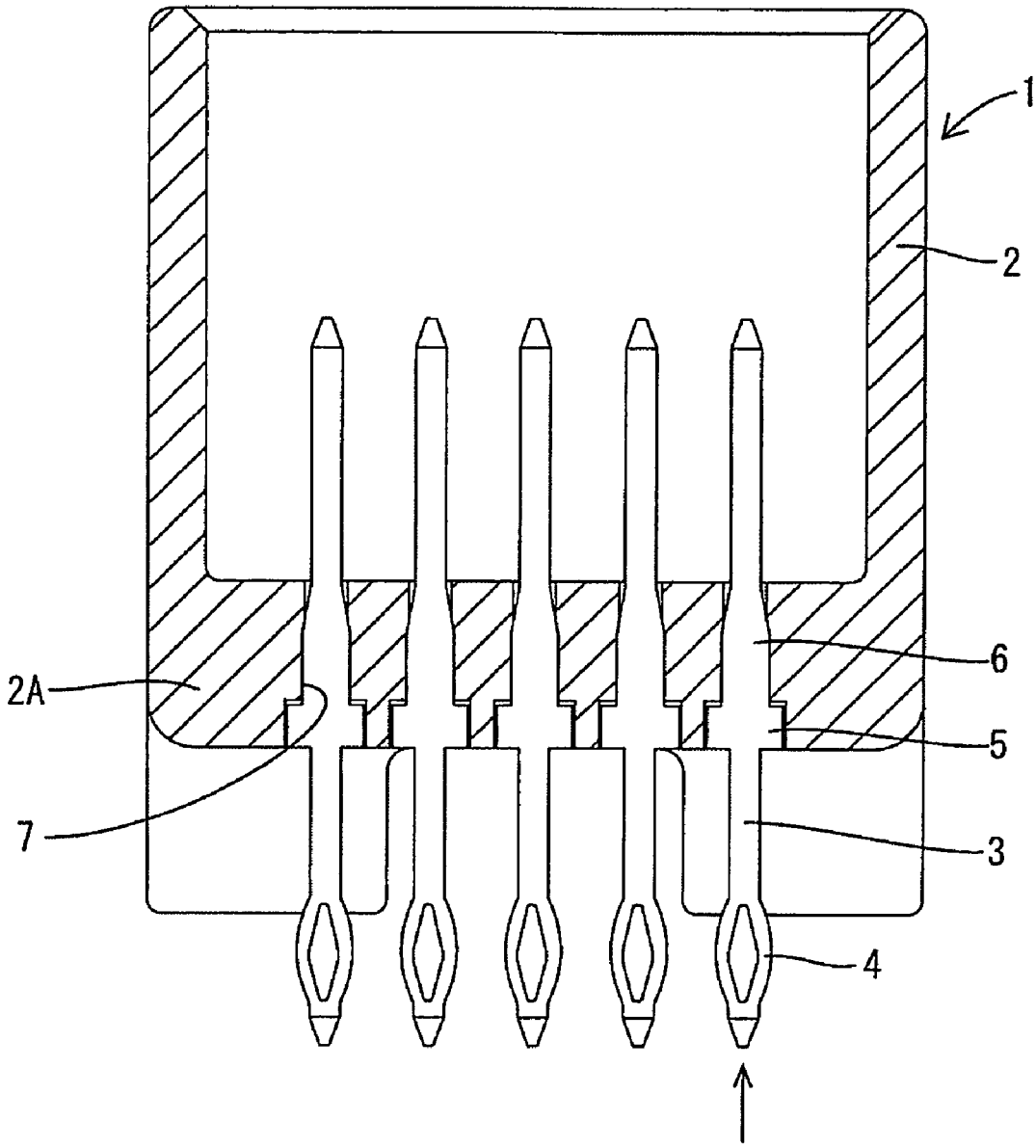
FIG. 11 is a section of a prior art circuit board connector.

The press-fit terminal 10 then is pushed further so that the press-in portion 13 enters the press-in hole 28 and bites in the opposite side walls of the press-in hole 28 along the direction of the dimension Wc as shown in FIG. 8(A). Pushing is stopped when the stopper 14 contacts the bottom surface of the accommodating hole 29, as shown in FIGS. 9 and 10. Thus, the press-fit terminal 10 is mounted while the resilient bulge 12 projects down from the base wall 21 and the terminal connecting portion 11 projects into the receptacle 22 from the upper surface of the base wall 21.

A jig or the like is used to insert the resilient bulges 12 of the press-fit terminals 10 into the through holes 31 of the circuit board 30, as shown in FIG. 9, after the press-fit terminals 10 are mounted to establish electrical connection with the contacts on the inner circumferential surfaces.

Some of the legs 23 are secured to the circuit board 30 with screws to fix the housing 20 to the circuit board 30. The mating connector then is fit into the receptacle 22 of the housing 20 to connect the terminal connecting portions 11 of the press-fit terminals 10 and mating terminals in the mating connector. At this time, a pushing force in the downward direction of FIG. 9 is exerted on the press-fit terminals 10. However, the stoppers 14 contact the bottom surfaces of the accommodating holes 29 to prevent the press-fit terminals 10 from being pushed any further. Therefore, the press-fit terminals 10 and the mating terminals in the mating connector are securely connected.

As described above, the press-fit terminal 10 is inserted from the inside of the receptacle 22 of the housing 20 and the insertion is limited by the contact of the stopper 14 with the bottom surface of the accommodating hole 29. A mating connector will urge the press-fit terminal 10 in the inserting direction as the mating connector is fit into the receptacle 22. However, further movement of the press-fit terminal 10 in this direction is prevented. In other words, the press-fit terminals 10 cannot escape when the mating connector is fit into the receptacle. Therefore the press-fit terminals 10 and the mating terminals in the mating connector can be connected with higher reliability.

The resilient bulge 12 and the press-in portion 13 are inserted into the through hole 26 and the press-in hole 28 which effectively are separate holes. Thus, the press-in portion 13 can be narrower than the resilient bulge 12 despite the fact that the resilient bulge 12 and the press-in portion 13 are passed through and into the base wall 21 in this order. Further, the stopper 14 is wider than the press-in portion 13, but can be made as narrow as possible. As a result the press-in hole 28 including the accommodating hole 29 can be narrower. The narrower press-in holes 28 are formed so that their width direction is aligned with the arranging direction of the press-fit terminals 10, thereby enabling the intervals of the press-in holes 28 to be narrowed. In other words, the press-fit terminals 10 can be arranged at narrower intervals.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The resilient bulge and the press-in portion of the press-fit terminal may take such postures as to cross each other at right angles, for example, by twisting a portion between them. In such a case, the resilient bulge can first pass through the through hole and then the press-in portion can be pressed into the press-in hole without changing the rotational posture.

Although the stopper is provided at the rear end of the press-in portion in the press-fit terminal of the foregoing embodiment, it need not be provided if the restriction on the insertion can be sufficiently expected due to the shape or the like of the press-in portion and such an embodiment is also embraced by the technical scope of the present invention.

The press-fit terminal is not limited to the straight shape illustrated in the foregoing embodiment, but may be L-shaped by being bent at right angles at an intermediate position.

What is claimed is:

1. A circuit board connector, comprising:

a plurality of press-fit terminals each having opposite first and second ends, a resilient bulge at the first end of each press-fit terminal and a press-in portion between the resilient bulge and the second end; and a housing formed with a connecting part for receiving a mating connector, the connecting part having a base wall formed with a plurality of inserting holes arranged in an arranging direction, each inserting hole having a press-in section and a through hole section, the press-in section of each inserting hole having a width measured parallel to the arranging direction that is dimensioned for receiving the press-in portion, and the through hole section of each inserting hole having a width measured substantially normal to the arranging direction that is dimensioned for permitting passage of the resilient bulge, wherein the resilient bulge and the press-in portion of each press-fit terminal bulge out in a common plane and the rotational posture of the press-fit terminal is turned 90° after the resilient bulge passes through the through hole section of the inserting hole, thereby enabling the press-in portion to be pressed into the press-in hole.

2. The connector of claim 1, wherein the press-fit terminals penetrate the base wall of the connecting part so that the second ends of the press-fit terminals project into the connecting part.

3. The connector of claim 2, wherein the resilient bulges project from a side of the base wall opposite from the connecting part.

4. The connector of claim 3, wherein the press-in portions are in the through hole sections of the inserting holes.

5. The connector of claim 1, wherein the resilient bulge and the press-in portion of each press-fit terminal are formed to have such postures as to cross each other at right angles.

6. The connector of claim 1, wherein the press-in hole has a lateral width greater than a width of a bar portion of the press-fit terminal and less than a width of the press-in portion so that the press-in portion can be press fit into the press-in hole.

7. The connector of claim 1, wherein a stopper is formed behind the press-in portion for abutting a corresponding portion of the housing, the stopper having a width which is larger than the maximal width of the resilient bulge.

8. A circuit board connector, comprising:

a plurality of press-fit terminals each having opposite first and second ends, a resilient bulge at the first end of each press-fit terminal and having a first width, a press-in portion between the resilient bulge and the second end and having a second width that is not greater than the first width, and a stopper between the press-in portion and the second end and having a third width that exceeds the second width, the first, second and third widths being measured parallel to one another; and a housing with a base wall having opposite first and second surfaces, a length direction and a width direction transverse to the length direction, a receptacle projecting from the second surface of the base wall for receiving a mating connector, a plurality of inserting holes extending through the base wall from the first surface to the second surface and arranged along the length direction, each inserting hole having a minimum first cross-sectional dimension measured substantially along the width direction that is dimensioned for permitting passage of the resilient bulge, each inserting hole having a press-in portion adjacent the first surface of the base wall, the press-in portion having a second cross-sectional dimension measured parallel to the length direction that is no greater than the second width defined by the press-in portion, and each inserting hole having an accommodating portion adjacent the second surface having a third cross-sectional dimension measured substantially parallel to the length direction, the third cross-sectional dimension being greater than the second cross-sectional dimension and being dimensioned for receiving the stopper.

9. The connector of claim 8, wherein the third cross-sectional dimension is greater than the third width.

10. The connector of claim 8, wherein the stopper has a length measured parallel to an axis between the first and second ends of the press-fit terminal, the accommodating potion having a depth from the second surface that is not greater than the length of the stopper.

11. The connector of claim 8, wherein the first end of each of the press-fit terminal fittings projects from the first side of the base wall, and wherein the second end of each of the press-fit terminal fittings projects from the second side of the base wall and into the receptacle.

12. A method of assembling a connector for a circuit board, comprising:

providing a housing with an arranging wall, a receptacle projecting from the arranging wall and inserting holes extending through the arranging wall;

providing a plurality of press-fit terminals each having a leading end, a trailing end, a resilient bulge in prox imity to the leading end and a press-in portion between the resilient bulge and the trailing end;

inserting the leading end of the press-fit terminal through the receptacle and sufficiently through the inserting hole in the arranging wall for the resilient bulge to clear the arranging wall;

rotating the press-fit terminal approximately 90° about an axis extending between the leading and trailing ends; and press-fitting the press-in portion into the inserting hole.

* * * * *